US005481247A

United States Patent [19]

Alexander et al.

[11] Patent Number: 5,481,247

[45] Date of Patent: Jan. 2, 1996

[54] BLAST FURNACE TUYERE SENSOR SYSTEM

[76] Inventors: James M. Alexander, 604 Stratford Ter., Valparaiso, Ind. 46383; Russell K. McComb, Jr., 345 Birch St. NW., DeMotte, Ind. 46310

[21] Appl. No.: 282,554

[22] Filed: Jul. 29, 1994

[51] Int. Cl.[6] ..... G08B 17/12

[52] U.S. Cl. ..... 340/578; 340/540; 356/5; 266/81; 266/267; 266/269

[58] Field of Search ..... 340/578, 540; 266/81, 84, 88, 269, 267, 142, 143; 374/141; 356/5, 381

[56] References Cited

U.S. PATENT DOCUMENTS

| | | | |
|---|---|---|---|
| 2,448,199 | 8/1948 | Vollrath | 266/84 |
| 3,178,234 | 4/1965 | Schulte et al. | 266/81 |
| 4,486,743 | 12/1984 | Brown | 340/540 |
| 4,619,533 | 10/1986 | Lucas et al. | 266/269 |
| 5,126,721 | 6/1992 | Butcher et al. | 340/578 |
| 5,173,245 | 12/1992 | Hall et al. | 266/267 |
| 5,223,908 | 6/1993 | Scott et al. | 356/5 |

FOREIGN PATENT DOCUMENTS

| | | |
|---|---|---|
| 8901208 | 5/1989 | Netherlands . |

*Primary Examiner*—John K. Peng
*Assistant Examiner*—Benjamin C. Lee
*Attorney, Agent, or Firm*—Armstrong, Westerman, Hattori, McLeland & Naughton

[57] ABSTRACT

A blast furnace tuyere sensor system comprising a conditioning circuit including a D.C. power supply, a potentiometer for base loading circuit voltage, and a photosensitive resistor sensor which outputs an analog voltage signal proportional to the intensity of the light falling on the sensor, and method and means to measure the output voltage signal and to actuate alarms when the measured voltage signal deviates in a predetermined manner or amount from the base load voltage indicative of a plugged tuyere, a bright tuyere or a defective sensor.

11 Claims, 8 Drawing Sheets

BLAST FURNACE TUYERE SENSOR SYSTEM

BACKGROUND OF THE INVENTION

1. Field of the Invention

This invention relates to a blast furnace tuyere sensor system in which a photosensitive element detects the light intensities of the several tuyeres and generates an analog voltage signal which can be analyzed to detect deviations from normal tuyere conditions, including a blocked tuyere, nearby "bright" tuyeres or defective sensors, enabling control of coal injection to the tuyeres responsive to such abnormal tuyere conditions.

2. Description of Related Prior Art

With the advent of pulverized coal injection into blast furnaces, it becomes critical to be able to detect problems in the injection system at the tuyeres. As coal injection rates increase, furnace downtime resulting from tuyere, blowpipe, and upper assembly failure also increases, often resulting in catastrophic furnace breakouts and damage to furnace auxiliary equipment.

It is known to use a photosensitive resistor to measure the absence of light from a tuyere through which finely divided coal is being injected into a blast furnace, thereby indicating blockage of the tuyere and enabling coal flow to that tuyere to be shut off. Netherlands patent document 8,901,208 discloses such a system which, for coal flow control, depends on detecting a plugged tuyere from the absence of light as determined by a photoresistor element.

Thus the Netherlands patent allows for the setting of a single "trip point" representing a blocked tuyere enabling the subsequent stopping of coal injection to that particular tuyere. That patent does not permit continuing analysis of the condition of a tuyere or, other than a plugged tuyere, the determination of conditions in nearby tuyeres.

We have found that the condition of tuyeres near to a plugged or blocked tuyere is indicative of possible failure of those nearby tuyeres. Such condition we call a "bright tuyere." We have found that a bright tuyere can be caused by several abnormal conditions, i.e. (1) a plugged injection lance, (2) sensor failure, or (3) coal in the bustle pipe of the furnace feeding air to the tuyeres. The carrying over of coal into the bustle pipe is an emergency condition which must be attended to immediately to avoid catastrophic consequences. When a tuyere shows blocked, while a downstream tuyere shows bright, the bright tuyere condition is being caused by burning coal being carried over from the blocked tuyere. A bright tuyere condition always needs to be investigated to avoid burn out of the tuyere and costly shutdown of the furnace. The Netherlands patent does not permit the determination of a bright tuyere condition or of other conditions, except a blocked tuyere, indicative of system malfunction.

SUMMARY OF THE INVENTION

Therefore, it is among the other objects of the present invention to provide means to detect a bright tuyere condition. This is accomplished by providing means to generate an analog voltage signal from each sensor by which to monitor the light intensity trends of all the tuyeres in a blast furnace, e.g. 35 tuyeres, enabling the devising of alarms when light intensity becomes abnormally low or high and the shut off of coal to an affected tuyere, where appropriate.

The development and use of the analog signal enables the determination of a definite set point for each tuyere for shut off of coal supply, not simply complete plugging of the tuyere. With use of the analog signal, it is possible to tell if a tuyere is almost (but not completely) plugged or if it is in the process of becoming plugged; if a tuyere is in the bright condition; if a sensor is responding at all, or if an injection lance is plugged (the signal increases and becomes unstable). Additionally, the analog signal provides the means for developing sensor alarms, rate of output change alarms, and total system electrical current alarms which can automatically monitor the condition of individual tuyeres and the system as a whole.

DESCRIPTION OF PREFERRED EMBODIMENTS

Figure 1:
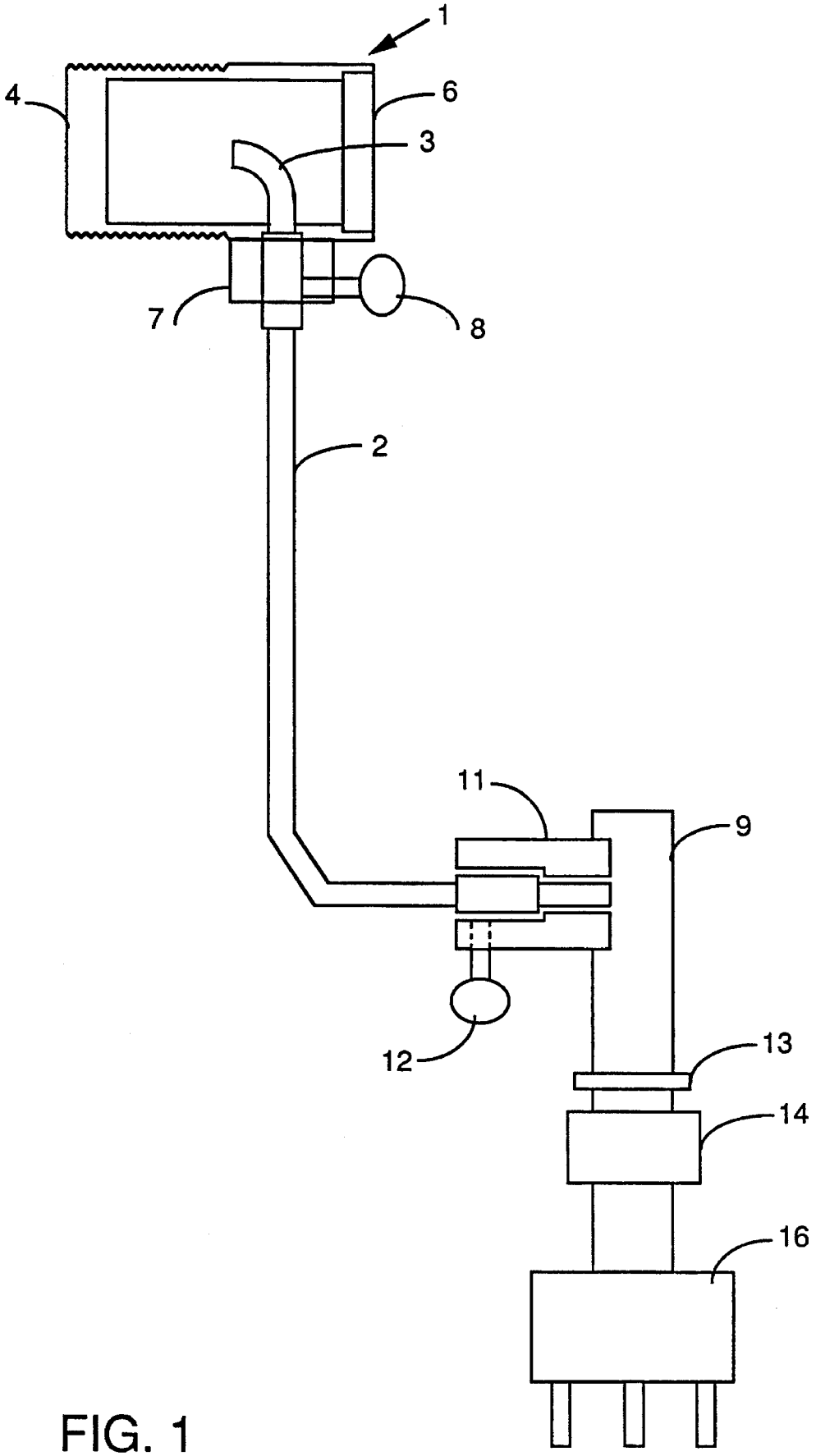
FIG. 1 is a sketch in side elevation of a peepsight and optical sensor.

In FIG. 1, a peepsight is denoted generally by the numeral 1. An optical cable 2, encased in stainless steel armor and a protective fire sleeve, has a special 90 degree termination portion 3 facing toward an observation port comprising a cobalt blue glass window 4 permitting a furnace operator to view the inside of the furnace by shielding the extremely bright light. A clear glass window 6 faces inwardly toward the furnace (not shown). Cable 2 is connected to the peepsight by means of bushing 7 and set screw 8 and to a sensor housing 9 by means of bushing 11 and set screw 12. Sensor housing 9 is connected to a tube end female adaptor 13, e.g. a Parker Hannifin part no. 4-4 T2HG-B which, in turn, is connected to a hardware mounting 14, attached to a standard size, 3-pin RTD plug 16 allowing the sensor to be easily plugged into the system by installing one RTD jack panel near each tuyere site. The sensor is a photoresistor, e.g. an Allen-Bradley photoswitch no. 47CN4-1005. The peepsight is more fully described in a copending application, entitled "Peepsight for Blast Furnace Tuyere Sensor System" of the present inventors and is incorporated herein by reference.

Figure 2:
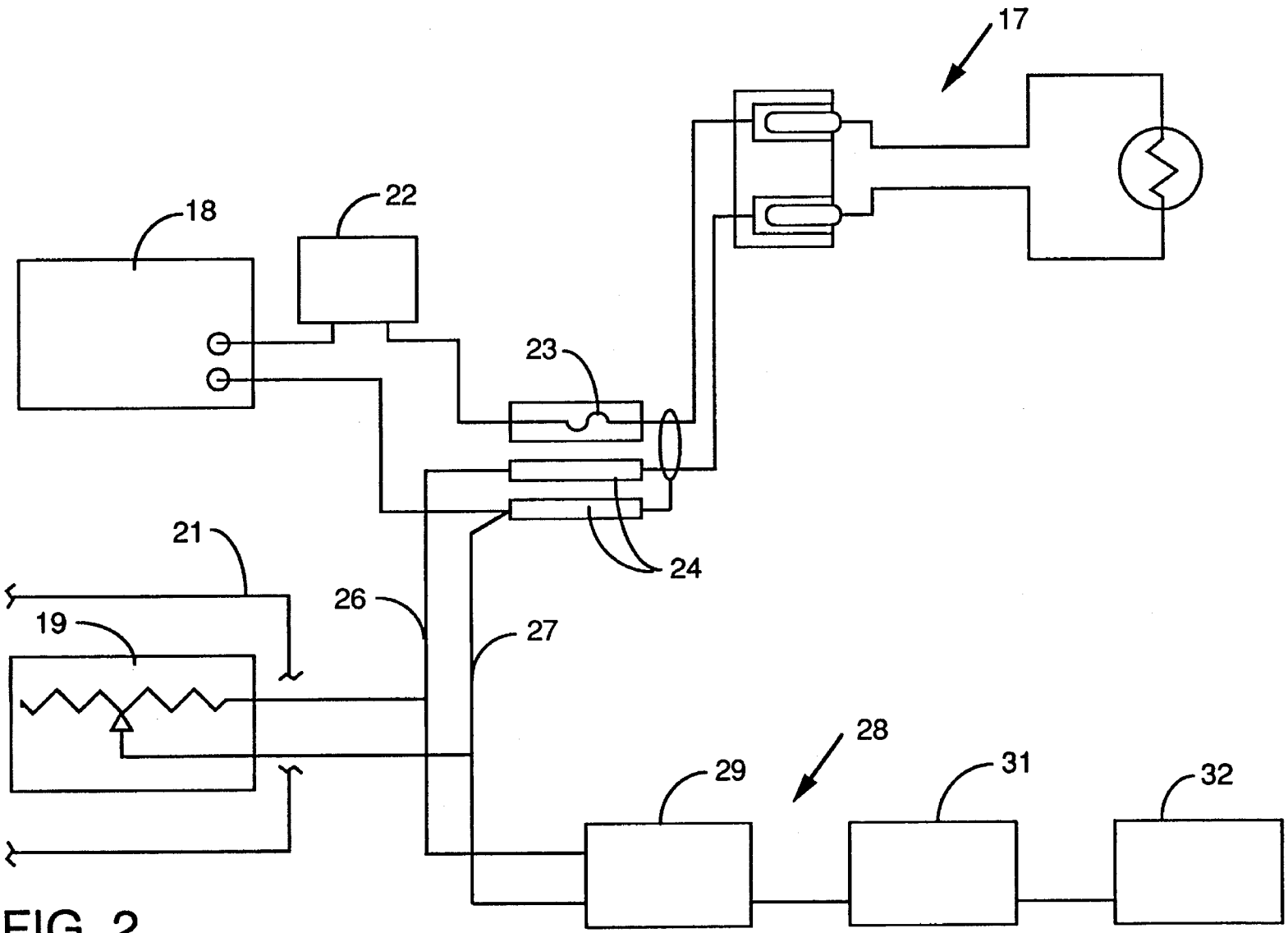
FIG. 2 is sketch of the conditioning circuitry of the invention.

FIG. 2 shows a photosensitive resistor sensor, denoted generally by the numeral 17, and associated conditioning circuitry. There is one sensor for each tuyere of the blast furnace, e.g. 35, each connected to a fiber optic cable and a corresponding peepsight. Each of these sensors has a photosensitive element, the resistance of which changes proportionally to the light entering its lens. A suitable sensor is an Allen-Bradley Photoswitch No. 47CN4-1005 which responds to light energy in the visible wavelength spectrum and is housed in a stainless steel package lending itself to coupling with standard or custom fittings. The sensors share a common power supply. The numeral 18 denotes a 10 volt VDC (volts direct current) power supply for powering the sensors and which, with a sensor, produces a 0–10 VDC analog signal. Other supply voltages could be employed and they would generate different levels of analog signals, e.g. for the purpose of generating signals more compatible with existing hardware. However, it is preferred that the power supply voltage should not exceed about 15 volts as higher voltages may cause premature failure of the photosensitive resistor.

The output of each sensor is an analog voltage signal having a span from zero, corresponding to a completely blocked tuyere, to a value, e.g. 10 V, corresponding to the most intense light emission from the tuyere. The voltage drop across each sensor is measured. As the intensity of the light falling on the sensor changes so does the resistance, R, and hence the voltage, V, in accordance with Ohm's law, V=IR. Resistance R is the variable in the equation. Resistance of the system also may be varied by means of trimpots. There is one trimpot, consisting of a 10 turn, 50,000 ohm potentiometer 19, for each sensor. These trimpots are contained in a cabinet 21 and are used for base loading the system, e.g. to 50% of the sensor voltage span, e.g. 5 volts. The system is base loaded to produce a 50% brightness signal on all tuyeres for several reasons. First, it allows for the setting of alarm and trip setpoints at values that are the same for all tuyeres. Second, it creates a basel line for comparison, not only between different tuyeres, but also on one individual tuyere over a period of time. The brightness trend of a particular tuyere may be as important as the gross value of brightness at an instantaneous point in time, that is to determine whether the tuyere is brighter or darker than it was previously; or if the tuyere is in process of plugging; or to determine if one tuyere goes bright and a different tuyere goes darker. Such types of comparisons, along with common alarm and trip setpoints, are made possible by starting with a common baseline of tuyere brightness. The value of 50% is chosen because it is in the middle of the possible analog voltage signal span. It permits determination of trends in brightness of a tuyere in each direction. Any voltage might be used, consistent with stability of the analog signals inherent to the system. If the baseline voltage were set too close to an alarm setpoint, there would be a risk of possible nuisance alarms and a meaningless trend. 50% gives ample room on both sides to avoid such possible problems.

The potentiometer 19 also permits system balancing and tuning. Thus, another purpose of the trimpots is to enable some adjustment of the analog signal generated by each sensor before it is delivered to the analysis and control means. This is necessary due to the intrinsic differences that exist between the light being emitted by the several tuyeres. Many factors can affect this light, for example, tuyere location in relation to tapholes, condition of the individual blowpipes, and insertion depth and angle of the injection lance. Of concern is the deviation of light intensity away from a baseline value and not necessarily with the gross amount of light itself. By setting these baselines equal, with use of the trimpots, it is possible to maintain alarm and shutdown points that are the same for all tuyeres. By starting with a consistent baseline, equal to the base load voltage, it is possible to analyze the condition of a tuyere over a period of time and determine, for example, whether the light intensity is increasing, decreasing or unchanging.

A current transmitter 22, which monitors the total current being drawn by the system, accepts a 0–100 milliamp direct current (MADC) and outputs a 4–20 MADC analog output.

A fuse 23 is disposed in the circuit between each sensor and the transmitter 22 to protect the system in case of signal shorts, and terminal strips 24 are provided for making connections.

The continuous D.C. voltage analog signal for each sensor is sent, through lines 26 and 27, to a programmable logic controller (PLC) denoted generally by the numeral 28 and which performs alarming and shutdown functions. The PLC also is used to monitor the output of current transmitter 22 and thus the total system current and to trigger an alarm when the current increases over acceptable levels. PLC 28 includes a PLC input card unit 29 of 0 to 10 VDC input, and a processor unit 31. PLC 28 is connected to a computer 32 for analysis of historical trending and data storage tasks. Operator inspection and interpretation of historical trends of the analog signals from each sensor provides a valuable trouble-shooting tool. For these latter purposes, any standard instrumentation and control equipment may be use, for example, alarming and shutdown functions might be handled by alarm modules and hard-wired relays, and historical trending could be done with a paper chart recorder.

Signals received from sensors 17 are in the form of raw data; they are scaled only in percentage units on a scale from a minimum signal value of 0 (representing minimum light emission from a tuyere) to a maximum signal value, e.g. 10 V (representing maximum light emission from a tuyere). Thus, in processor 31., 0 VDC=0%; 10 VDC=100%. Alarm and shutoff are set at a value of 5%–10% of the maximum signal voltage, e.g. 7%, indicating a blocked tuyere, and an alarm is set for 85%–90%, e.g. 85%, of the maximum signal voltage, denoting a bright tuyere. Thus the analog signals are analyzed and alarmed for the following conditions. First, analysis is made for a blocked tuyere condition. An alarm is activated by a signal of 10% or less, and indicates that the raceway, tuyere, blowpipe or peepsight is plugged or nearly plugged. This condition automatically halts the coal injection at the affected tuyere. Second, analysis is made for a bright tuyere condition. This alarm is activated by a signal of 85% or higher and indicates that the sensor is detecting an unusually bright light source at the tuyere. Experimentation and operating experience have shown that there are two conditions which can trigger such an event; the abrupt cessation of coal injection or by coal "carry over." Coal carry over is the more serious condition. It occurs when a tuyere becomes plugged and the coal for that tuyere backs up into the bustle pipe of the furnace and burns there, exceeding refractory specifications. Coal is then carried over into the next tuyere resulting in the emission of exceptionally bright light. This condition also has the consequence of blowing that blow pipe out of the furnace, causing much damage and long downtime, in addition to the adverse personnel safety aspect. Third, the analog signal is analyzed for a tuyere sensor alarm which is activated when a sensor fails to function properly and needs to be replaced. Thus, a sensor which appears to be non-responsive, or which draws a straight line signal, or which becomes unstable, alarms as a sensor failure and halts coal injection to the affected tuyere. An unstable signal is indicated by erratic swings of measured voltage over relatively short periods of time. Additionally, total current flow to the entire system, i.e, all 35 tuyeres, is monitored to detect sensor or wiring faults and power supply problems. Thus, in the system above described, a total system current over 25 MADC will trigger an alarm. Although coal flow is not halted by such an alarm, the alarm will not clear until the source of the high current is found. It has been found that a malfunctioning sensor usually will trigger such an alarm.

Figure 3:
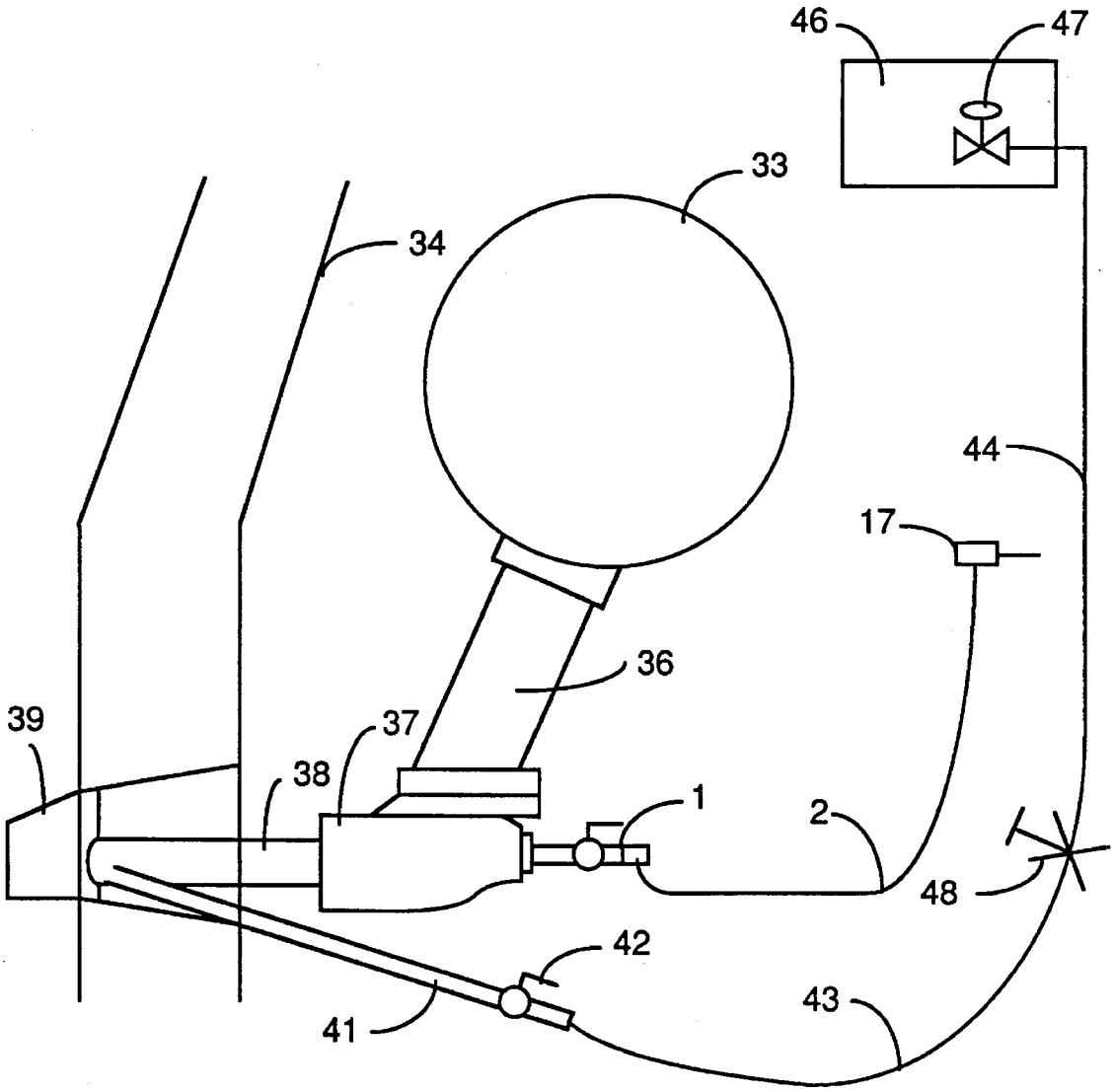
FIG. 3 is a side elevational view, in sketch form, of the means for supplying and controlling coal flow to the tuyeres.

The coal flow supply and control means are depicted in FIG. 3 in which a refractory-lined bustle pipe 33 encircles the blast furnace 34. A blast of hot air, e.g. at about 2100° F. and at about 60 psi pressure, is delivered from the bustle pipe 33 to a refractory-lined upper assembly 36 forming a transition between the bustle pipe 33 and a refractory-lined blowpipe 37. An extension 38 of the blowpipe 37 extends through the furnace wall and into communication with a tuyere 39 which is a water-cooled cast copper nozzle extending from the furnace wall into the furnace. An injection lance 41 comprising, e.g. a 1¾ inch diameter pipe, has one end thereof extending through the blowpipe wall and terminating at the inlet to the tuyere. Pulverized coal is delivered to the injection lance, by compressed air, through a lance shut-off valve 42, from a length of flexible hose 43 serving as a transition piece between lance 41 and a length of solid pipe 44 connected at the other end to a pulverized coal injection distribution house 46 which houses, e.g. 35 remotely controlled automatic shutoff valves 47, that is, one for each tuyere. Control valves 47 are either fully open or fully closed and it is these valves which are operated by the control mechanism of the present invention to halt coal injection in case of malfunction. A manually operated shutoff valve 48 enables changing of flexible hose 43 and lance 41. The peepsight 1 is connected to the end of blowpipe 37 and a multi-mode, multi-fiber, fused silica fiber optic cable 2 is connected at one end to the peepsight and at the other end to a photosensitive sensor 17. The process can be viewed through the peepsight 1. Optical cable 2 serves as a conduit for the light energy leaving the peepsight and entering the optical sensor 17 which is a part of the conditioning circuitry of FIG. 2. PLC 28 is programmed such that, when an analog voltage signal indicating a blocked tuyere or a bright tuyere is received, automatic shut off valves 47 are actuated to shut off coal supply to the affected tuyere or tuyeres. Resupply of coal is accomplished manually by the operator.

The coal delivery system is separate from the hot blast delivery system. It is at the tuyere where they form a common junction and coal backup becomes of concern. Thus, the exact design and specifications for coal delivery may vary from that above described but the danger of a blocked tuyere is a common one. If a tuyere becomes blocked and thereby prevents injected coal from reaching the interior of the furnace, the coal will go into the bustle pipe and burn at above refractory limits. The coal then will be carried to the next available tuyere where burning destroys the hot blast delivery system at that location. The result is a catastrophic and dangerous failure of hot blast delivery equipment such as tuyere, tuyere cooler, blowpipe, upper assembly and bustle pipe.

Figure 4:
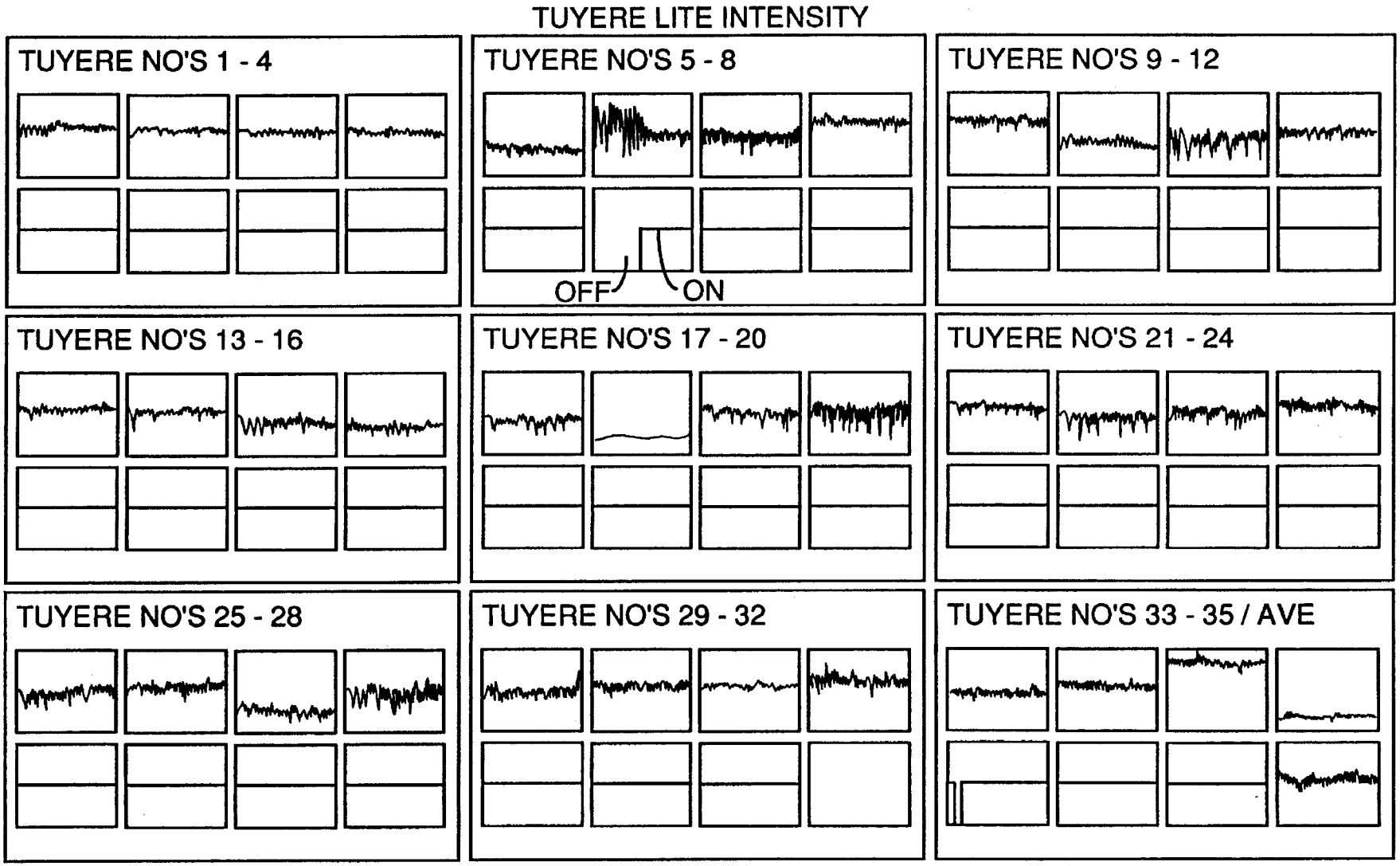
FIG. 4 is a chart showing the analog signal produced by the invention, with a bright tuyere condition appearing in the signal.

FIG. 4 shows the analog D.C. voltage signals representing light intensity measured at all 35 tuyeres of a typical blast furnace installation. The upper row of blocks show the measured light intensity; the lower row of blocks indicate whether coal is being injected or not. Note tuyere No. 26 where the signal became unstable. This was due to a plugged lance. As shown in the lower box, coal flow was terminated for a time and then resumed when the plug was removed; thereupon signal stability returned.

Figure 5A:
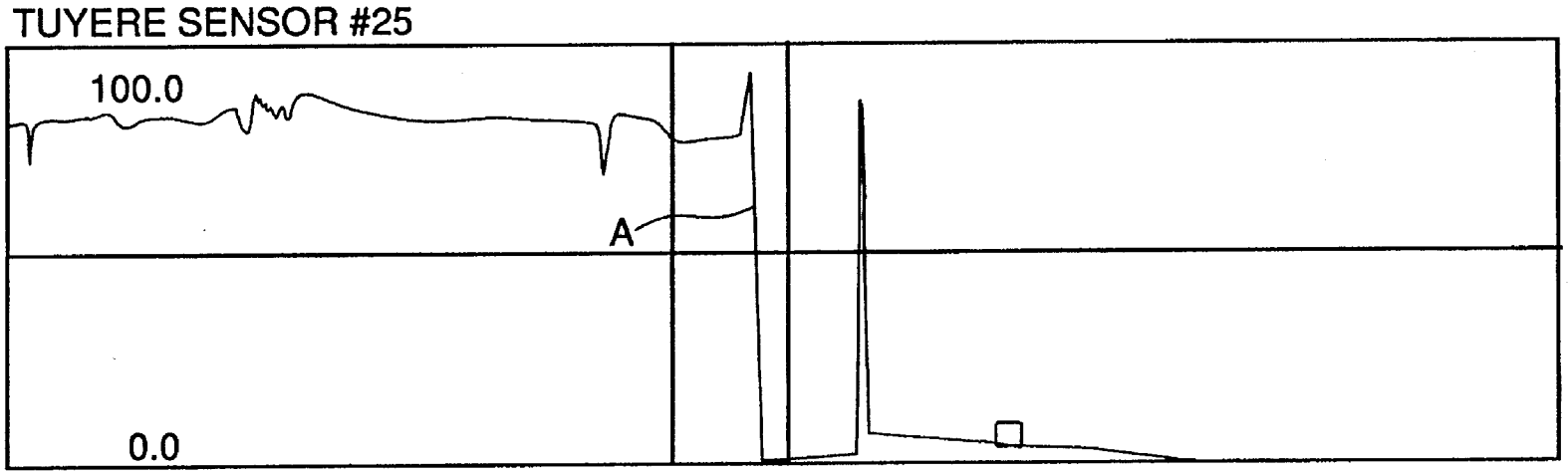
FIG. 5 is a chart showing a plugged tuyere and catastrophic failure of an adjacent bright tuyere.
Figure 5B:
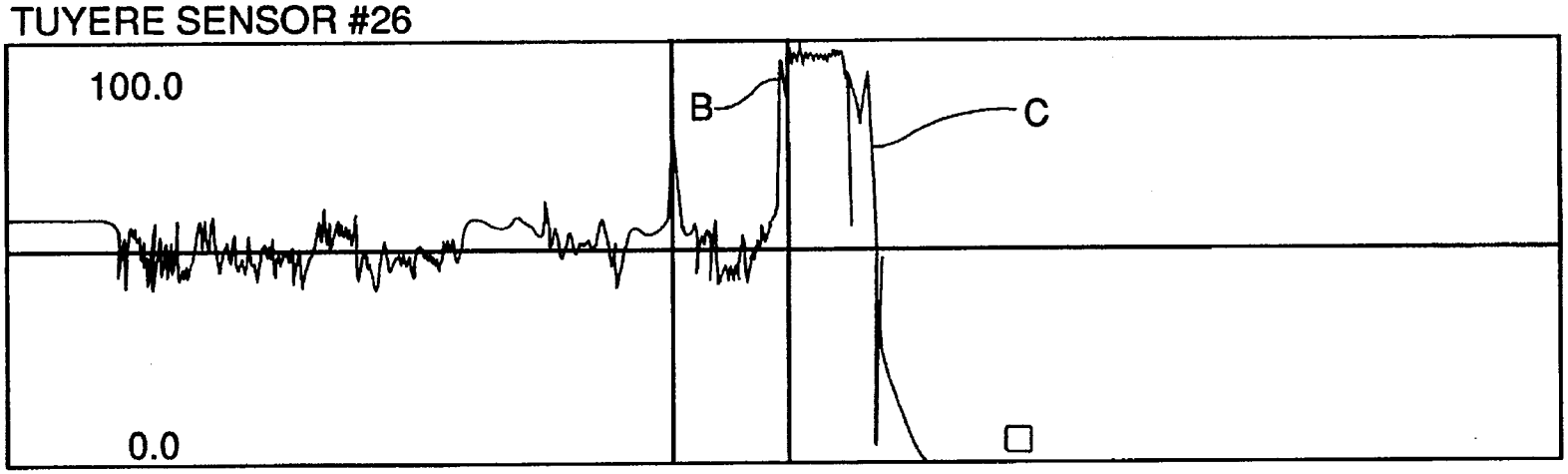

FIG. 5 shows the result of a plugged tuyere and a downstream bright tuyere from which coal supply was not shut off. Note that tuyere number 25 became plugged and the analog signal abruptly dropped to zero as shown at A on the chart. As a consequence, adjacent tuyere number 26 went bright as shown at B, and failed, as shown at C, being blown from the furnace some 20 ; minutes later. The net result was a catastrophic wreck causing long downtime and lost production.

Figures 6A, 6B, 6C, 6D:
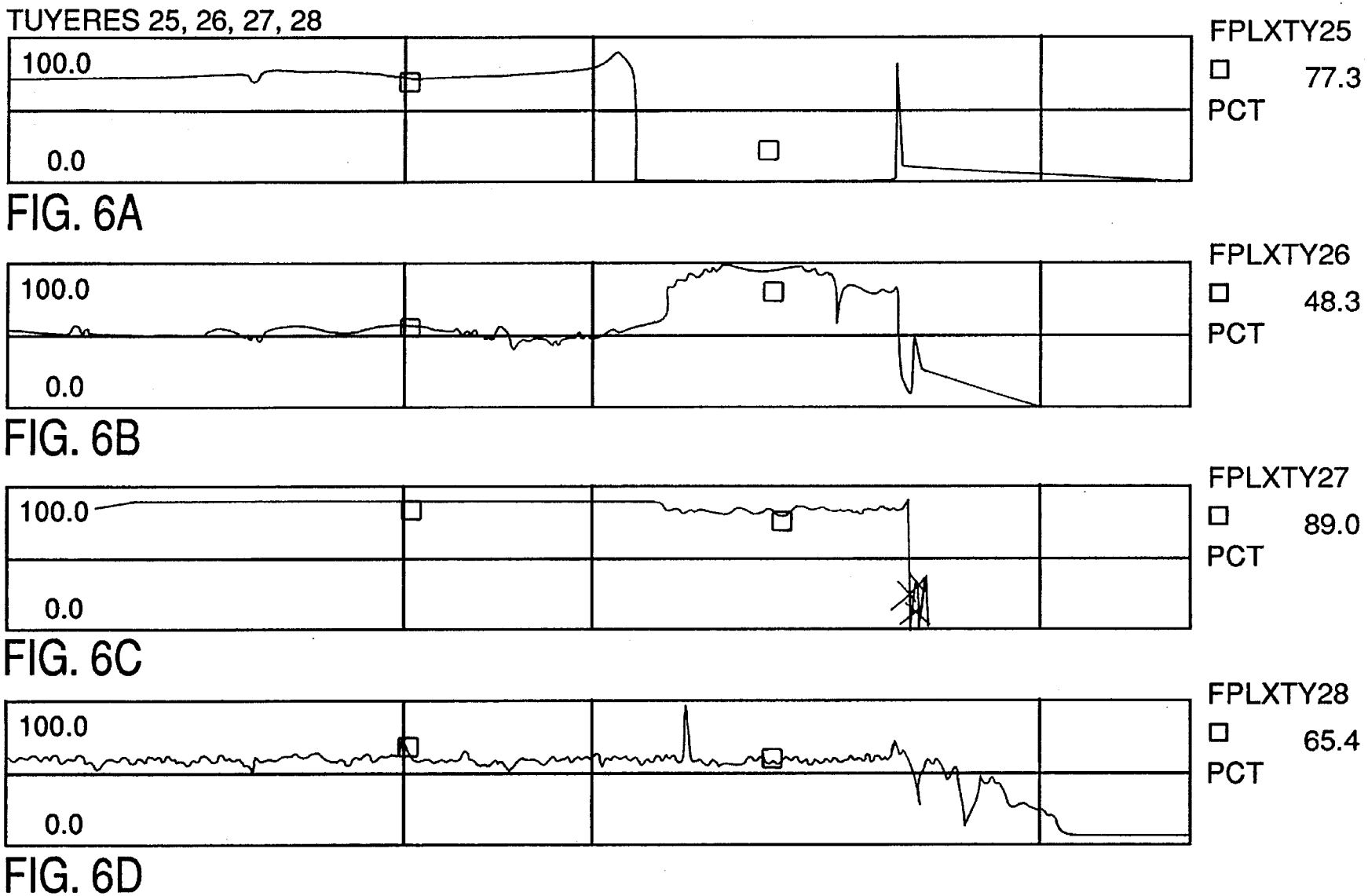
FIG. 6 is a chart showing a blocked tuyere and downstream bright tuyeres.

The chart of FIG. 6 shows how the system of the invention predicts and prevents tuyere and blowpipe failures and furnace breakouts. The light intensity at tuyere No. 25 has abruptly dropped towards zero, while nearby downstream tuyere Nos. 26, 27 and 28 show an inverse effect, i.e. bright tuyeres. If the coal flow to these affected tuyeres is halted with this initial change in light intensity, no furnace damage will result. However, if coal continues to flow unabated, a breakout will occur at one or more of the bright tuyeres, as was the case shown in FIG. 5. In this case, without the application of the invention, tuyere No. 26 failed, resulting in a delay exceeding 31 hours.

Figure 7:
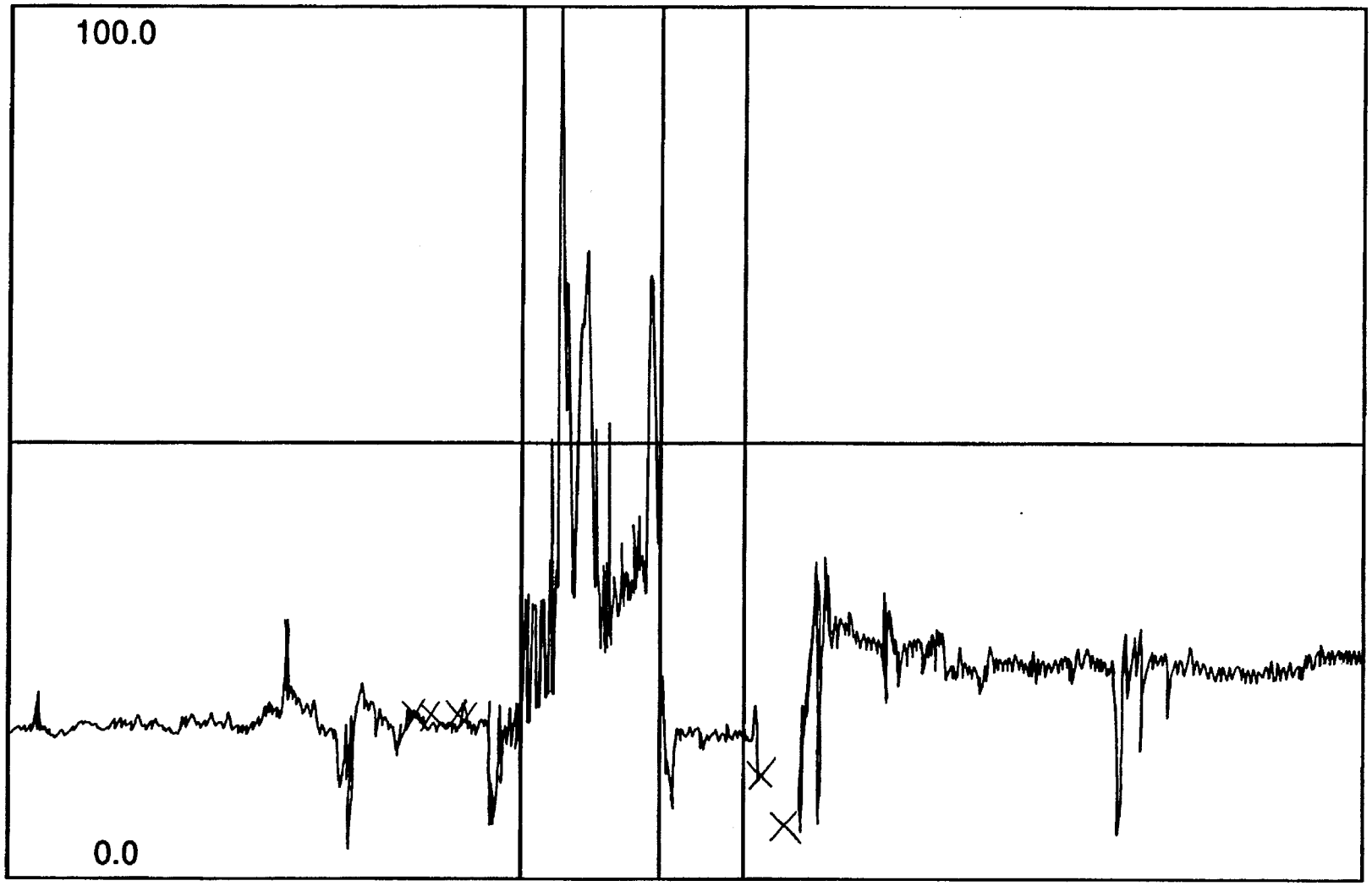
FIG. 7 is a chart showing total system current.

FIG. 7, a chart of the total system current signal, shows how the total system current rose abruptly to high levels and became unstable. In this case, two different sensors were found to be bad and unable to detect dark. Once the sensors were changed, the current was reduced and again became stable. There were no other indications that these sensors were defective; they continued to output signals sufficient to avoid triggering other alarms.

Figure 8:
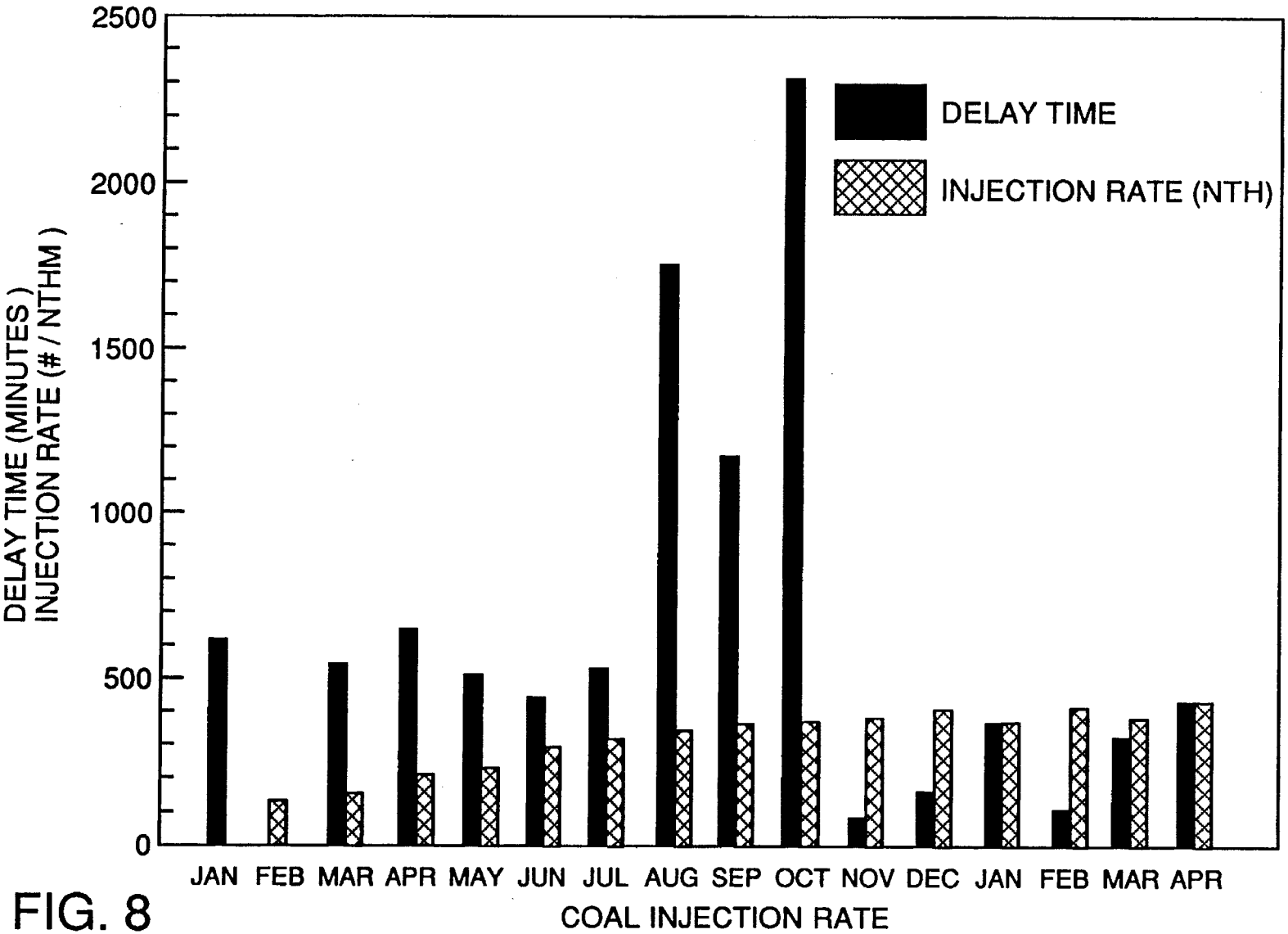
FIG. 8 is a graph relating coal injection rate and time delays in operation of a blast furnace, before and after installation of the present invention.

FIG. 8 shows the results of application of the invention to the operation of coal injection in a blast furnace. In the period from January to April of a first year there were many instances of delay and furnace downtime due to problems with plugged tuyeres or blowpipes. In contrast, when the system of this invention was installed, in October of that year, delay and downtime were drastically reduced, even at highest coal injection rates, over 400 pounds per net ton of hot metal.

The system of the invention has been used successfully with other fuel injectants such as natural gas, oil and tar.

What is claimed is:

1. In the operation of a blast furnace tuyere system of the type including a plurality of photoresensitive resistor sensors corresponding to the number of tuyeres in the blast furnace and for which the electrical resistance of each sensor and, correspondingly in accordance with Ohm's law, the voltage varies proportionally to the intensity of light falling on the sensor, a method of continuously detecting and measuring changing intensity of light from each blast furnace tuyere through which a fuel is injected, comprising impressing on an electrical conditioning circuit including the sensor, a D.C. power supply and a potentiometer, a predetermined supply voltage greater than zero, with use of the potentiometer adjusting the circuit voltage to a base load value greater than zero and less than the supply voltage, generating an analog D.C. voltage signal proportional to the light intensity falling on each such sensor, measuring the generated analog voltage signal; and responsive to determining whether the measured analog voltage signal is being above or being below the base load voltage to greater than a respective predetermined percentage of a maximum analog signal voltage, whether a sensor is being unresponsive, and whether the measured analog voltage signal is straight line or unstable, actuating one or more alarms indicating tuyere conditions.

2. A method according to claim 1, comprising actuating a first alarm indicating a plugged tuyere if the measured analog voltage signal reaches a predetermined percentage of the maximum analog voltage signal between the base load voltage and zero, actuating a second alarm indicating a bright tuyere if the measured analog voltage signal reaches a predetermined percentage of the maximum analog voltage signal between the base load voltage and 100% of the maximum analog voltage signal, and actuating a third alarm indicating a defective sensor if the measured analog voltage signal is unresponsive, is a straight line or becomes unstable.

3. A method according to claim 2, further comprising adjusting, with use of the potentiometer, the analog voltage signal generated by each sensor to a common baseline value before measuring the analog voltage signals from each sensor.

4. A method according to claim 3, further comprising continuously measuring the total circuit current, generating an electrical signal corresponding to the measured current, and actuating a fourth alarm if the current signal exceeds a predetermined maximum value.

5. A. method according to claim 4, further comprising measuring the rate of change of the analog-voltage signal generated by each sensor, and actuating a fifth alarm if the measured rate of change for any sensor exceeds a predetermined value.

6. A method according to claim 3, further comprising shutting off the fuel supply to an affected tuyere when the first, second or third alarm is actuated.

7. A method according to claim 2, wherein the supply voltage is about 10 volts to about 15 volts, the base load voltage is about 50% of the maximum analog voltage signal, actuating the first alarm when the measured analog voltage signal reaches about 5% to 10% of the maximum analog voltage signal indicating tuyere blockage, and actuating the second alarm when the measured analog voltage signal reaches about 85% to 90% of the maximum analog voltage signal indicating a bright tuyere.

8. In a blast furnace system for injecting fuel into a blast furnace tuyere, a blast furnace tuyere sensor system including a conditioning circuit comprising:

a photosensitive resistor sensor for which the electrical resistance, and, correspondingly in accordance with Ohm's law, the voltage varies proportionally to the intensity of light falling on the sensor;

a D.C. power supply for impressing on the circuit a supply voltage greater than zero;

a potentiometer for adjusting the circuit voltage to a base load value greater than zero and less than the supply voltage and for adjusting an analog voltage output signal from said sensor to the base load value;

means to measure an analog D.C. voltage signal proportional to the light intensity falling on the sensor, and means for actuating one or more alarms indicating tuyere conditions, said actuating means being responsive to determining whether the measured analog voltage signal deviates to more than a predetermined percentage of a maximum analog signal voltage above or below the base load voltage, whether the sensor is unresponsive, and whether the measured analog voltage signal becomes straight line or unstable.

9. A system according to claim 8, comprising a first alarm means actuated to identify a blocked tuyere when the measured analog voltage signal reaches a predetermined percentage of the maximum analog voltage signal between the base load voltage and zero, a second alarm means actuated to identify a bright tuyere when the measured analog voltage signal reaches a predetermined percentage of the maximum analog voltage signal between the base load voltage and 100% of the maximum analog voltage signal, and a third alarm means actuated to identify a defective sensor when the sensor becomes unresponsive or when the measured analog voltage signal becomes a straight line or unstable.

10. A system according to claim 9, further including means to shut off fuel flow to affected tuyeres responsive to the first, second and third alarms.

11. A system according to claim 9, further including means to measure the total current in the conditioning circuit, and means to actuate a fourth alarm when said current reaches a predetermined maximum value.

* * * * *